US006772859B2

(12) United States Patent
D'Antonio et al.

(10) Patent No.: US 6,772,859 B2
(45) Date of Patent: Aug. 10, 2004

(54) EMBODIMENTS OF APERIODIC TILING OF A SINGLE ASYMMETRIC DIFFUSIVE BASE SHAPE

(75) Inventors: Peter D'Antonio, Upper Marlboro, MD (US); Trevor J. Cox, Chorlton (GB)

(73) Assignee: RPG Diffusor Systems, Inc., MD (US)

( * ) Notice: Subject to any disclaimer, the term of this patent is extended or adjusted under 35 U.S.C. 154(b) by 0 days.

(21) Appl. No.: 10/254,844

(22) Filed: Sep. 26, 2002

(65) Prior Publication Data

US 2004/0060771 A1 Apr. 1, 2004

(51) Int. Cl.[7] ..... E04B 1/82; E04B 1/99
(52) U.S. Cl. ..... 181/293; 181/295; 181/30
(58) Field of Search ..... 81/293, 286, 295, 81/30, 288, 285

(56) References Cited

U.S. PATENT DOCUMENTS

| | | | | | |
|---|---|---|---|---|---|
| 1,875,074 | A | * | 8/1932 | Mason | 181/293 |
| 2,779,429 | A | * | 1/1957 | Mazer | 181/293 |
| 4,296,831 | A | * | 10/1981 | Bennett | 181/224 |
| D291,601 | S | * | 8/1987 | D'Antonio et al. | D25/160 |
| 4,821,839 | A | * | 4/1989 | D'Antonio et al. | 181/198 |
| 4,964,486 | A | * | 10/1990 | D'Antonio et al. | 181/285 |
| 5,160,816 | A | * | 11/1992 | Chlop | 181/285 |
| 5,401,921 | A | * | 3/1995 | D'Antonio et al. | 181/286 |
| 5,665,943 | A | * | 9/1997 | D'Antonio | 181/295 |
| 5,764,782 | A | * | 6/1998 | Hayes | 381/160 |
| 5,817,992 | A | * | 10/1998 | D'Antonio | 181/295 |
| 5,959,264 | A | * | 9/1999 | Bruck et al. | 181/286 |
| 6,112,852 | A | * | 9/2000 | D'Antonio et al. | 181/295 |
| 6,290,022 | B1 | * | 9/2001 | Wolf et al. | 181/292 |
| 6,431,312 | B1 | * | 8/2002 | D'Antonio | 181/295 |

FOREIGN PATENT DOCUMENTS

| | | | | | |
|---|---|---|---|---|---|
| DE | 3412921 | A1 | * | 10/1985 | E01F/8/00 |
| JP | 02212896 | A | * | 8/1990 | G10K/11/20 |

* cited by examiner

*Primary Examiner*—Shih-Yung Hsieh
*Assistant Examiner*—Edgardo San Martin
(74) *Attorney, Agent, or Firm*—H. Jay Spiegel

(57) ABSTRACT

Embodiments of aperiodic tiling of a single asymmetrical diffusive base shape employ welled or stepped one-dimensional or two-dimensional diffusors, a single or compound curved surface, or an aperiodic geometrical form. Surfaces are tiled in any orientation offering an unlimited number of tiling patterns. In the preferred embodiments of the present invention, a smooth transition between adjacent "tiles" is achieved. Using a single tileable asymmetric base shape reduces the number of shapes requiring manufacture while allowing modulation. The present invention even contemplates extending the inventive techniques into three-dimensional shapes to form volume diffusors. The technique employed to design diffusors to be used in accordance with the teachings of the present invention may rely upon visual appearance, a random sequence, a number theory sequence, or use of an optimization program.

35 Claims, 23 Drawing Sheets

FIG. 12
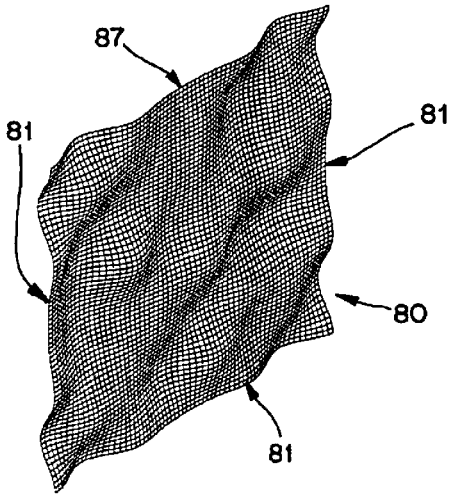
FIG. 14
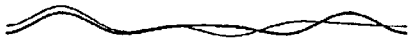
FIG. 13
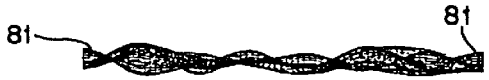
FIG. 16
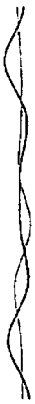
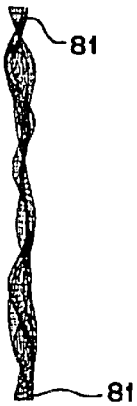
FIG. 15
FIG. 17
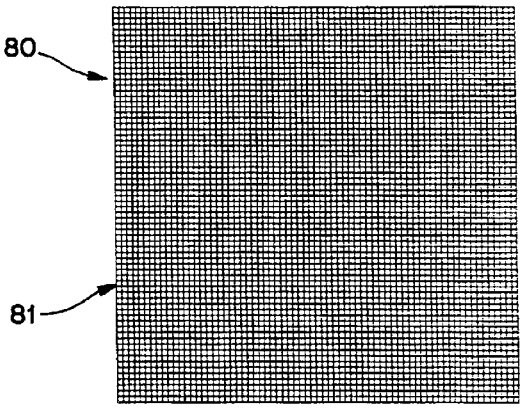

FIG. 21
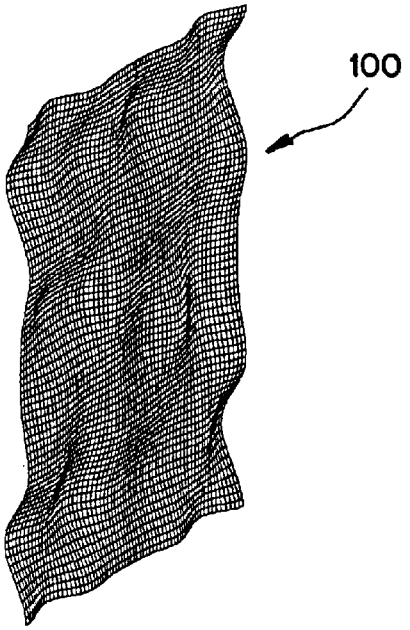
FIG. 23
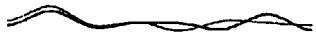
FIG. 22
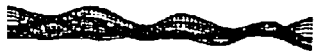
FIG. 25
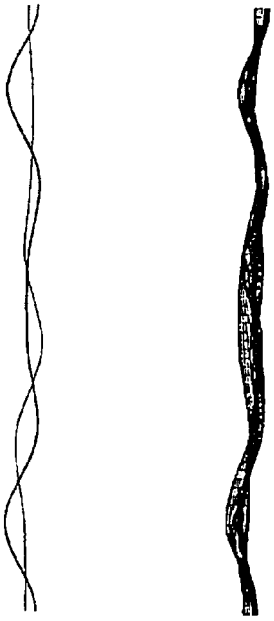
FIG. 24
FIG. 26
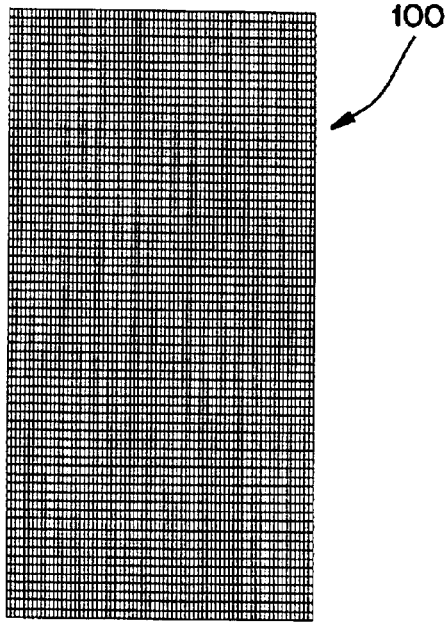

FIG. 33
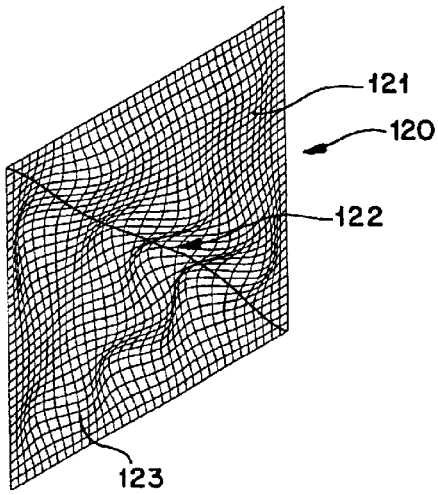
FIG. 35
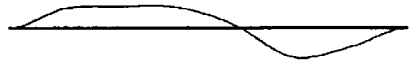
FIG. 34
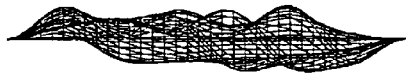
FIG. 37
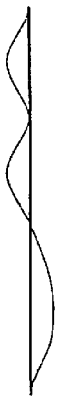
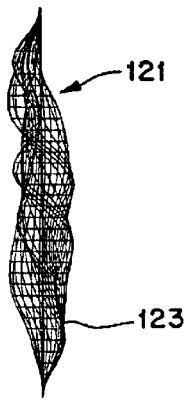
FIG. 36
FIG. 38
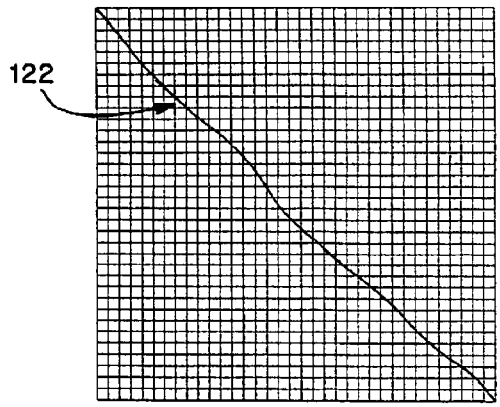

FIG. 56
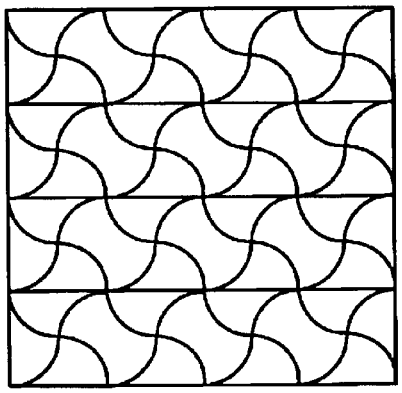
FIG. 57A
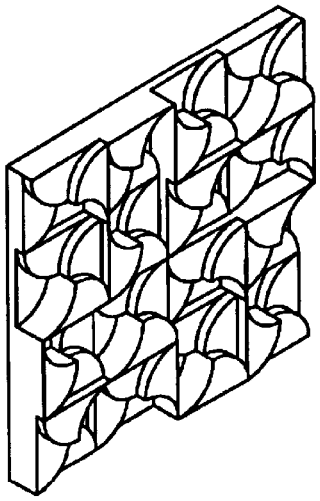
FIG. 57B
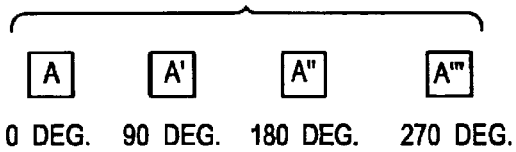
FIG. 57C
| | | | |
|---|---|---|---|
| A | A' | A" | A''' |
| A''' | A" | A' | A |
| A" | A''' | A | A' |
| A' | A | A''' | A" |

FIG. 58
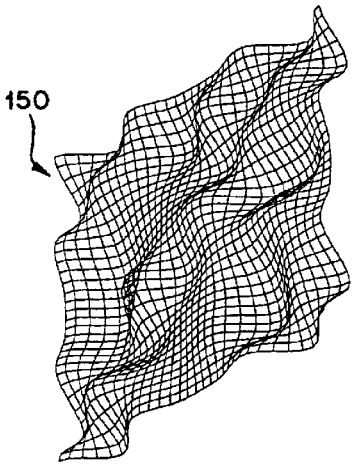
FIG. 60
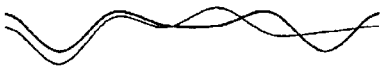
FIG. 59
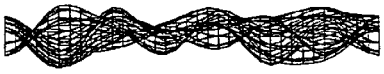
FIG. 62
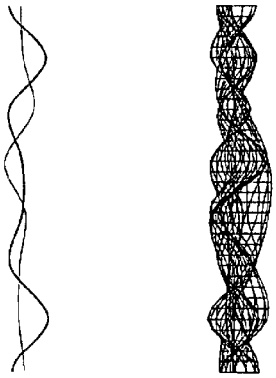
FIG. 61
FIG. 63
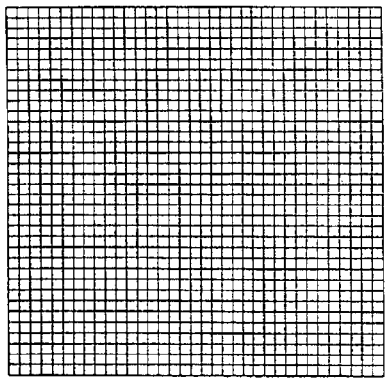

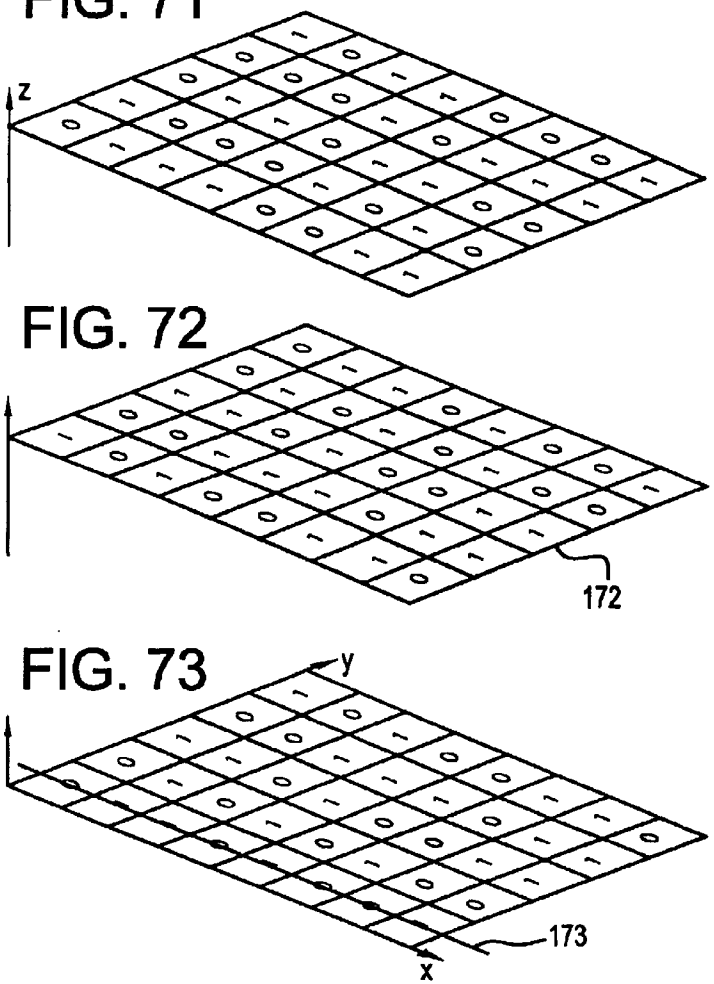
FIG. 71
FIG. 72
FIG. 73
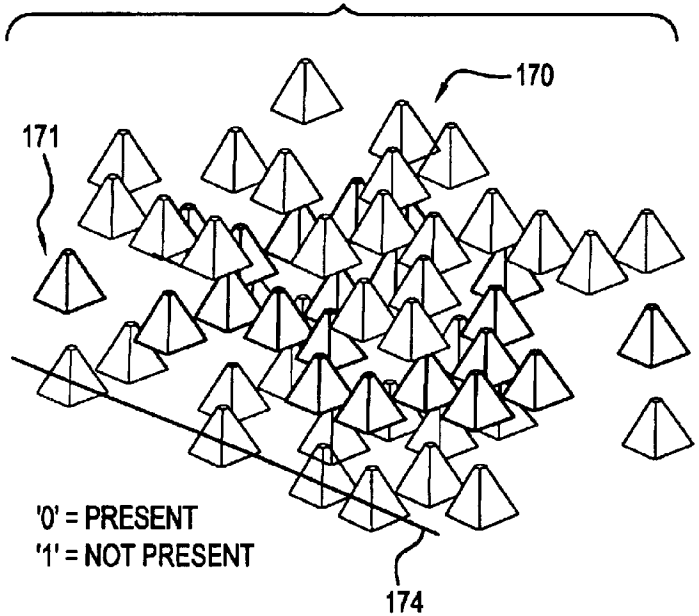
FIG. 70

EMBODIMENTS OF APERIODIC TILING OF A SINGLE ASYMMETRIC DIFFUSIVE BASE SHAPE

BACKGROUND OF THE INVENTION

Acoustic surface diffusers are well known for use in scattering or diffusing sound reflections. Such devices are used to alter the acoustics of an environment. When arranging multiple diffusers on a surface such as a wall, it is a common practice to employ a periodic array. In other words, a pattern of recesses or protrusions is arranged to repeat itself over and over again across the surface being treated. Such a practice is widely acceptable from a visual perspective and is advantageous in that it reduces manufacturing costs. Unfortunately, periodic repetition of a series of acoustic features such as wells or protrusions often reduces the effectiveness of diffusion and/or scattering and, consequently, the ability of the diffusing surface to disperse sound. Thus, a need has developed for an acoustical diffusor system that avoids the deficiencies of the use of repetitive periodic arrays of diffusing elements.

If a scattering surface is made so that an array is periodic, i.e., having many repeats of a single base shape, then there will be directions where scattered energy lobes form due to constructive interference between identical parts of the repeated base shapes. In the example of scattering in a single plane with normal incident plane waves, for many audible frequencies, repetition lobes dominate the scattered energy polar response. This can mean that the scattered energy is concentrated in only a few directions, resulting in uneven coverage and less than complete diffusion. In this regard, the far field scattered energy is independent of scattering angle. In a simple example of a base shape having a width W, and the wavelength of sound is $\lambda$, then the repetition lobes will be in the directions $\theta$ according to the formula $\theta=\sin^{-1}(m\lambda/W)$, where m is an integer with $|m\lambda/W|\leqq 1$.

One solution to the problem of periodicity is to increase the repeat length W while still maintaining some periodicity as this will generate more scattering lobes and therefore make diffusion more complete. This is generally an expensive approach since the large base shape is more expensive to fabricate or mold. Another more effective solution is to remove periodicity altogether, while manufacturing a relatively small asymmetric shape.

While one solution to the issue of periodicity is to make a surface having no repeats, this is often not an effective solution because (1) periodicity is often a visual requirement of the customer, and (2) manufacturing costs become prohibitive. Angus suggested the use of modulation using two different base shapes of Schroeder diffusors, where the first base shape is denoted A, and the second base shape is denoted B. Angus suggested that the base shapes A and B could be arranged in random order on a wall surface, for example, in the pattern A A A B A (J. A. Angus "Using Modulated Phase Reflection Gratings to Achieve Specific Diffusion Characteristics" presented at the 99$^{th}$ Audio Engineering Society Convention, pre-print 4117 (October, 1995)).

Such a solution reduces or removes periodicity effects but still often results in a shape which is random and difficult to visually decode. In addition, if a solution could be obtained using only a single base shape, manufacturing costs would be drastically reduced over the manufacturing costs that would be required to implement the concept disclosed by Angus.

SUMMARY OF THE INVENTION

The present invention relates to embodiments of aperiodic tiling of a single asymmetrical diffusive base shape or module. The present invention includes the following interrelated objects, aspects and features:

(1) In accordance with the teachings of the present invention, Applicants have found that by forming an aperiodic arrangement, sequence or array of diffusors, or by increasing repeat unit length, the effects of periodicity can be removed or reduced. We are describing two diffusors—an asymmetrical base shape and an extended arrangement of this base shape in two or three dimensions and in diverse orientations forming a larger aperiodic diffusor having minimal scattered energy lobing. In the past, multiple Schroeder diffusor base shapes have been arranged to form an aperiodic array. The present invention seeks to improve upon that technique by providing other ways of achieving an aperiodic tiled array using a single asymmetrical base shape which is either a welled or stepped one-dimensional or two-dimensional diffusor, a single or compound curved surface, or an aperiodic geometrical form.

(2) Surfaces such as those described in paragraph (1) above can be tiled in any orientation offering an unlimited number of tiling patterns. In the preferred embodiments of the present invention, a smooth transition between adjacent "tiles" is achieved because the perimeter of each tile is provided with a specific depth and zero gradient whereby when adjacent tiles are placed in adjacency, there is a smooth transition between the adjacent tiles. For example, where the diffusor is a one-dimensional diffusor, a half well is provided at each end thereof which precisely matches a half well formed on the adjacent tile. In this way, two adjacent half wells create a single well, thereby providing a continuity in transition between adjacent tiles. Application of this principle to two-dimensional diffusers, single or compound curved surfaces or aperiodic geometric forms will be explained in greater detail hereinafter. However, using a tileable single asymmetric base shape reduces the number of shapes requiring manufacture while allowing modulation. The present invention even contemplates extending the techniques thereof into three-dimensional shapes to form volume diffusors.

(3) An asymmetrical welled diffusor base shape or module can be designed in a variety of ways including use of numerical optimization. As explained above, diffusors can be single plane (one-dimensional) or hemispherical (two-dimensional) as well as other curves and shapes. Whereas prior diffusors have employed the use of number theory sequences, the present invention does not require the use of number theory sequences in determining the pattern of wells in the diffusor. Applicants have shown that use of boundary element and multi-dimensional optimization techniques can be used to design diffusors with better performance than number theory approaches, especially for diffusors with a limited number of wells. Thus, one example of an optimized one-dimensional diffusor usable in accordance with the teachings of the present invention can include eight wells including 7 full wells and a half well at each end. A depth sequence that has been found to be effective in practicing the teachings of the present invention includes a depth sequence equal to or proportional to the following: 0", 3", 6 7/16", 3 7/8", 5 1/16", 2 11/16", 4 5/8 and 13/16".

(4) The technique employed to design aperiodic diffusor sequences to be used in accordance with the teachings of the present invention may rely upon visual appearance, a random sequence, a number theory sequence, or use of an optimization program.

Accordingly, it is a first object of the present invention to provide embodiments of aperiodic tiling of a single asymmetric diffusive base shape or module.

It is a further object of the present invention to provide such a device, in each embodiment, in which a single form of diffusor is conceived, and is arranged in a sequence either as conceived or re-oriented so as to eliminate periodicity.

It is a still further object of the present invention to provide such a device applicable to one-dimensional, two-dimensional and three-dimensional diffusors.

It is a still further object of the present invention to provide such a device applicable to three-dimensional geometrical shapes and simple or compound curves.

It is a yet further object of the present invention to provide such a device in which the perimeter of each tile is specifically designed to provide a smooth transition to adjacent tiles.

It is a yet further object of the present invention to provide such a device in which knowledge of the eventual visual appearance is employed in designing the diffusors to be employed therein.

It is a yet further object of the present invention to design the diffusor sequences randomly, in accordance with a number theory sequence, or through the use of an optimization program.

It is a yet further object of the present invention to provide such a device in which the diffusors are asymmetrical.

These and other objects, aspects and features of the present invention will be better understood from the following detailed description of the preferred embodiments when read in conjunction with the appended drawing figures.

BRIEF DESCRIPTION OF THE DRAWINGS

FIG. 12 shows a perspective view of a square asymmetrical compound curved surface diffusor having identical and symmetrical sides of zero gradient.

FIG. 13 shows a top view of the diffusor of FIG. 12.

FIG. 14 shows a view of the top edge of the diffusor of FIGS. 12 and 13.

FIG. 15 shows a side view of the diffusor of FIGS. 12–14.

FIG. 16 shows a view of the side edge of the diffusor of FIGS. 12–15.

FIG. 17 shows a front view of the diffusor of FIGS. 12–16.

FIG. 21 shows a perspective view of a rectangular asymmetrical compound curved surface diffusor having two pairs of identical and symmetrical peripheral sides.

FIG. 22 shows a top view of the diffusor of FIG. 21.

FIG. 23 shows a top edge of the diffusor of FIGS. 21 and 22.

FIG. 24 shows a side view of the diffusor of FIGS. 21–23.

FIG. 25 shows a view of the side edge of the diffusor of FIGS. 21–24.

FIG. 26 shows a front view of the diffusor of FIGS. 21–25.

FIG. 33 shows a perspective view of a varying height curved "Log Cabin" sound diffusor.

FIG. 34 shows a top view of the diffusor of FIG. 33.

FIG. 35 shows a top edge of the diffusor of FIGS. 33 and 34.

FIG. 36 shows a side view of the diffusor of FIGS. 33–35.

FIG. 37 shows a view of the side edge of the diffusor of FIGS. 33–36.

FIG. 38 shows a front view of the diffusor of FIGS. 33–37.

FIG. 56 shows a front schematic representation of a tiling pattern using the diffusor of FIGS. 52–55.

FIG. 57*a* shows a perspective view of the tiling pattern illustrated in FIG. 56.

FIG. 57*b* shows a schematic representation of four rotative orientations of the tiles shown in FIG. 57*a*.

FIG. 57*c* shows a schematic representation of the tiling pattern of FIG. 57*a* showing the tile orientations using the symbols shown in FIG. 57*b*.

FIG. 58 shows a perspective view of a morphed fractal surface diffusor.

FIG. 59 shows a top view of the diffusor of FIG. 58.

FIG. 60 shows a top edge of the diffusor of FIGS. 58 and 59.

FIG. 61 shows a side view of the diffusor of FIGS. 58–60.

FIG. 62 shows a view of the side edge of the diffusor of FIGS. 58–61.

FIG. 63 shows a front view of the diffusor of FIGS. 58–62.

FIG. 70 shows a 3×5×7 binary optimized defect volume diffusor.

FIGS. 71, 72 and 73 show three binary planes used to form the volume diffusor of FIG. 70 in which the designation "0" corresponds to the presence of a module, and wherein the designation "1" corresponds to the absence of a module.

SPECIFIC DESCRIPTION OF THE PREFERRED EMBODIMENTS

Figure 1:
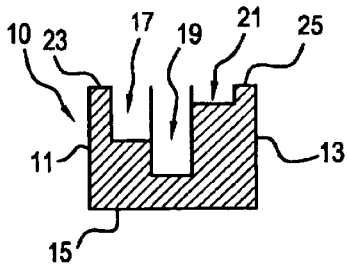
FIG. 1 shows a cross-sectional view of a one-dimensional diffusor.
Figure 2:
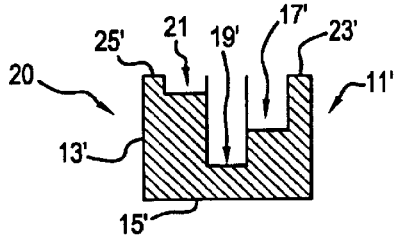
FIG. 2 shows a cross-sectional view of the one-dimensional diffusor of FIG. 1 rotated 180° from the orientation of the diffusor of FIG. 1.
Figure 3:
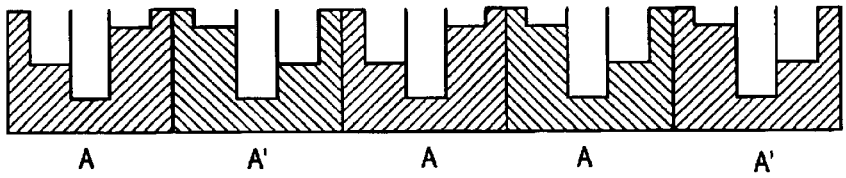
FIG. 3 shows an aperiodic arrangement of diffusors as shown in FIG. 1 and FIG. 2.

With reference, first, to FIGS. 1–3, a one-dimensional asymmetrical base shape module is generally designated by the reference numeral 10 and is seen to include sides 11, 13, a bottom 15, and asymmetrical series of wells 17, 19 and 21. Additionally, adjacent to the well 17 is a surface 23 that is half the width of a well and, similarly, adjacent to the well 21 is a surface 25 half the width of a well. The diffusor illustrated in FIG. 1 is also described in FIG. 3 using the reference letter A.

With reference to FIG. 2, a diffusor 20 comprises a mirror image of the diffusor module 10 formed by rotating the diffusor 10 180° about a vertical axis, and like elements are designated using like primed numbers. Thus, the diffusor 20 includes side walls 11', 13', a bottom wall 15', wells 17', 19' and 21', as well as surfaces 23' and 25', each of which is half the width of a well. The diffusor 20 is also referred to in FIG. 3 by the reference letter A'.

With reference to FIG. 3, an aperiodic arrangement of diffusor modules 10 and 20 is shown and is provided in accordance with the teachings of the present invention in the random pattern A A'AAA'. Applicants refer to the ordering of the diffusor modules 10 and 20 as depicted by the letters A and A' in FIG. 3 as a modulation sequence. Even if a truly random sequence is not formed, if a lengthening of the repeat distance can be achieved, the number of lobes that are created will increase as will diffusor performance. For example, the arrangement AAA'A'AAA'A'AAA'A' has a repeat distance of 2W, where W is the width of one diffusor A or A'. Such an arrangement will, in most cases, have a better diffusion characteristic than a simple periodic arrangement of A or A'. Through use of the half width surfaces 23, 25 or 23', 25', the concept of zero depth, zero gradient tiling is achieved since when two units are placed in adjacency, a full width well is produced by the two adjacent half width surfaces to enhance visual continuity.

Figure 4:
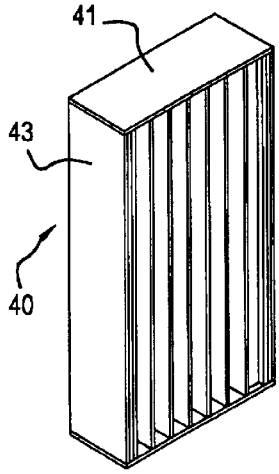
FIG. 4 shows a perspective view of an optimized one-dimensional asymmetrical diffusive base shape which can be modulated in accordance with the teachings of the present invention.
Figure 5:
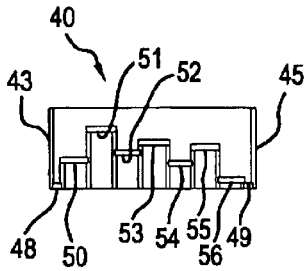
FIG. 5 shows a cross-sectional view of the diffusor shown in FIG. 4.
Figure 6:
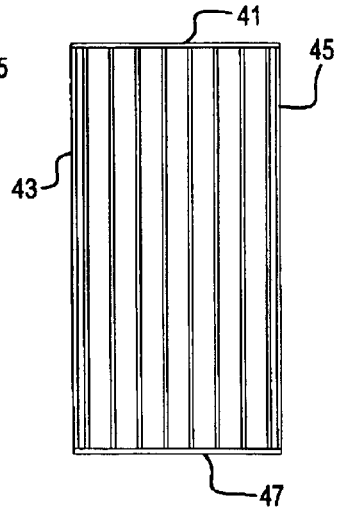
FIG. 6 shows a front view of the diffusor shown in FIGS. 4 and 5.
Figure 7:
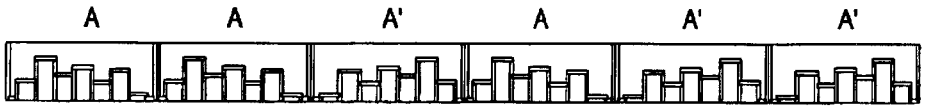
FIG. 7 shows an aperiodic arrangement of a plurality of diffusors, with the diffusors consisting of (1) diffusors corresponding to FIGS. 4–6, and (2) diffusors corresponding to a reoriented diffusor as illustrated in FIGS. 4–6.

With reference to FIGS. 4–6, a diffusor module 40 is seen to include a top surface 41, side surfaces 43 and 45, as well as a bottom surface 47 (FIG. 6). As seen in particular in FIG. 5, the diffusor 40 has a sequence of wells of particular depths. As a first matter, the diffusor module 40 has end wells 48 and 49 that are half the width of the other wells and have zero depth. The remaining seven wells are designated by the following reference numerals and have the following depths: the well 50—3 inches, the well 51—6 7/16 inches, the well 52—3 7/8 inches, the well 53—5 1/16 inches, the well 54—2 11/16 inches, the well 55—4 5/8 inches, and the well 56—13/16 inches. Applicants have found that making a diffusor module having a pattern of wells having depths equal to or proportional to those described above and specifically depicted in FIG. 5 operates as an effective diffusor in an array including a random placement of diffusor modules 40 as well as diffusers comprising the mirror image of the diffusor module 40 formed by rotating the module 40 180° about the vertical axis thereof. In FIG. 7, the diffusor module 40 is designated by the reference letter A, while a mirror image of the diffusor module 40, which comprises the module 40 rotated 180°, is designated by the reference letter A'. With reference to FIG. 7, it is seen that six diffusor modules are provided in an aperiodic configuration using one asymmetrical base shape. Based upon the use of the half width, zero depth side surfaces, designated by the reference numerals 48 and 49 in FIG. 5, the tiled array appears to be continuous.

Figure 8:
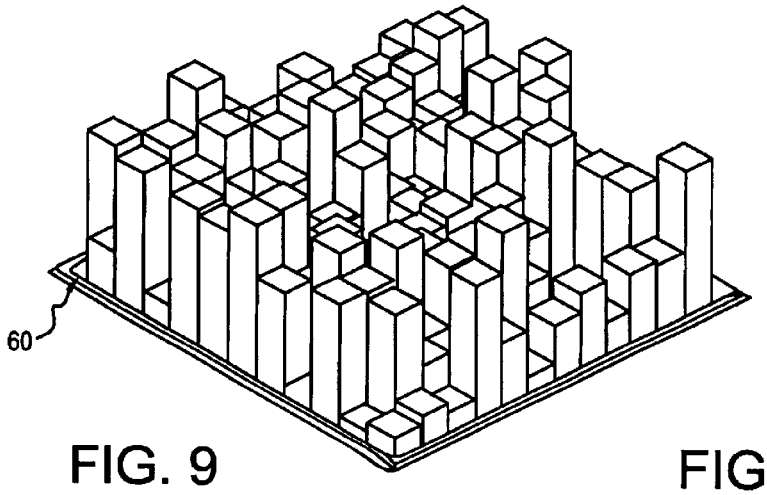
FIG. 8 shows a top view of a large format two-dimensional diffusor which is defined by square blocks of differing heights rather than by divided linear wells.

With reference now to FIG. 8, a diffusor module 60 is shown generally as disclosed in Applicants' prior U.S. Pat. No. 5,401,921. The single asymmetric base shape modulation concept forming a part of the present invention may be applied to a two-dimensional diffusor module such as is shown in FIG. 8 by using efficient molding techniques like injection molding. If desired, one can mold a smaller asymmetrical base shape and modulate it as desired. The use of blocks instead of linear divided wells eliminates the requirement for half wells.

Figure 9:
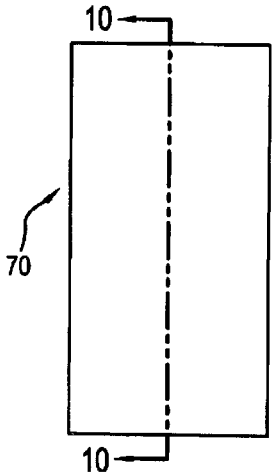
FIG. 9 shows a front view of an asymmetrical single curvature diffusor having equal displacement and zero gradient edges.
Figure 10:
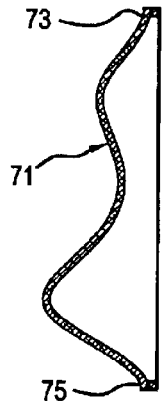
FIG. 10 shows a cross-sectional view along the line 10—10 of FIG. 9.
Figure 11:
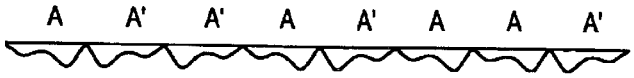
FIG. 11 shows an aperiodic arrangement of diffusors consisting of (1) diffusors in accordance with FIGS. 9 and 10, and (2) diffusors comprising a reoriented diffusor as illustrated in FIGS. 9 and 10.

With reference now to FIGS. 9–11, a single curved surface and a modulated array are shown. The surface of the diffusor module 70 is seen in FIG. 9 to be rectangular. The cross-sectional view of FIG. 10 shows a curved surface 71 as well as a specific height zero gradient periphery designated by the reference numerals 73 and 75. This zero gradient periphery permits continuous tiling. The diffusor module shown in FIGS. 9 and 10 is designated in FIG. 11 by the reference letter A. The mirror image thereof formed by rotating 180° about the vertical axis is designated in FIG. 11 by the reference letter A'. A modulated array of diffusor modules A and A' is depicted in FIG. 11.

With reference now to FIGS. 12–17, a multiple curved surface diffusor module is generally designated by the reference numeral 80. As shown in FIG. 17, the diffusor module 80 is generally square-shaped. As in the other embodiments, the periphery presents a zero gradient to allow transition between adjacent diffusors. The periphery is designated by the reference numeral 81 as seen in FIGS. 13 and 15.

Figure 18:
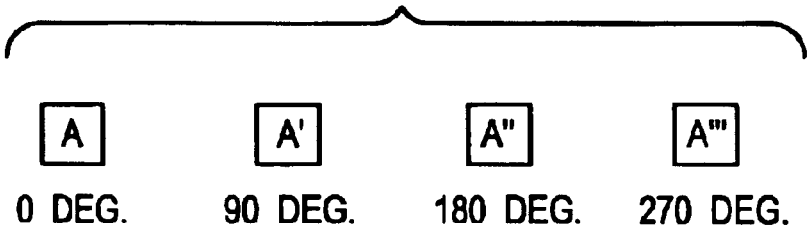
FIG. 18 shows a schematic representation of four variations of the diffusor illustrated in FIGS. 12–17, with each variation consisting of the identical diffusor rotated 90° with respect to an adjacent unit.
Figure 19:
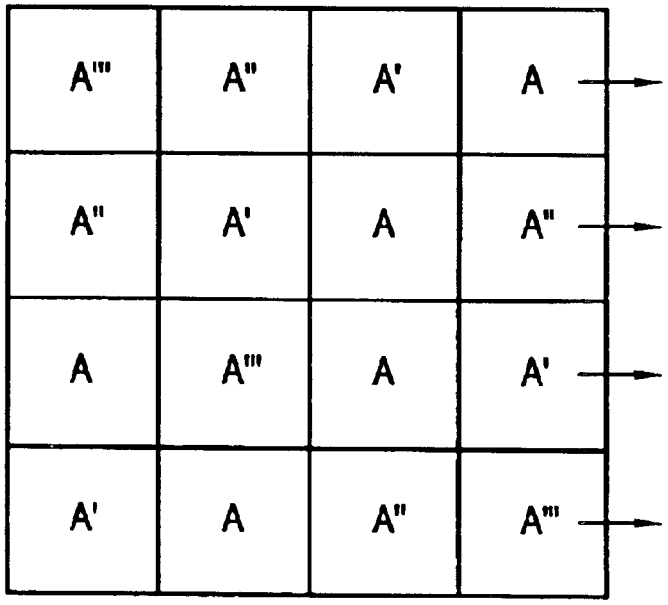
FIG. 19 shows an aperiodic array of the diffusors oriented as illustrated in FIG. 18.

FIGS. 18 and 19 illustrate one possible modulated array consisting of orientations of the diffusor module 80. As shown in FIG. 18, four different orientations, each rotatably spaced apart by 90°, are respectively designated by the reference letters A, A', A", A'". The array shown in FIG. 19 shows a random arrangement of those varied orientation configurations of the diffusor module 80.

Figure 20:
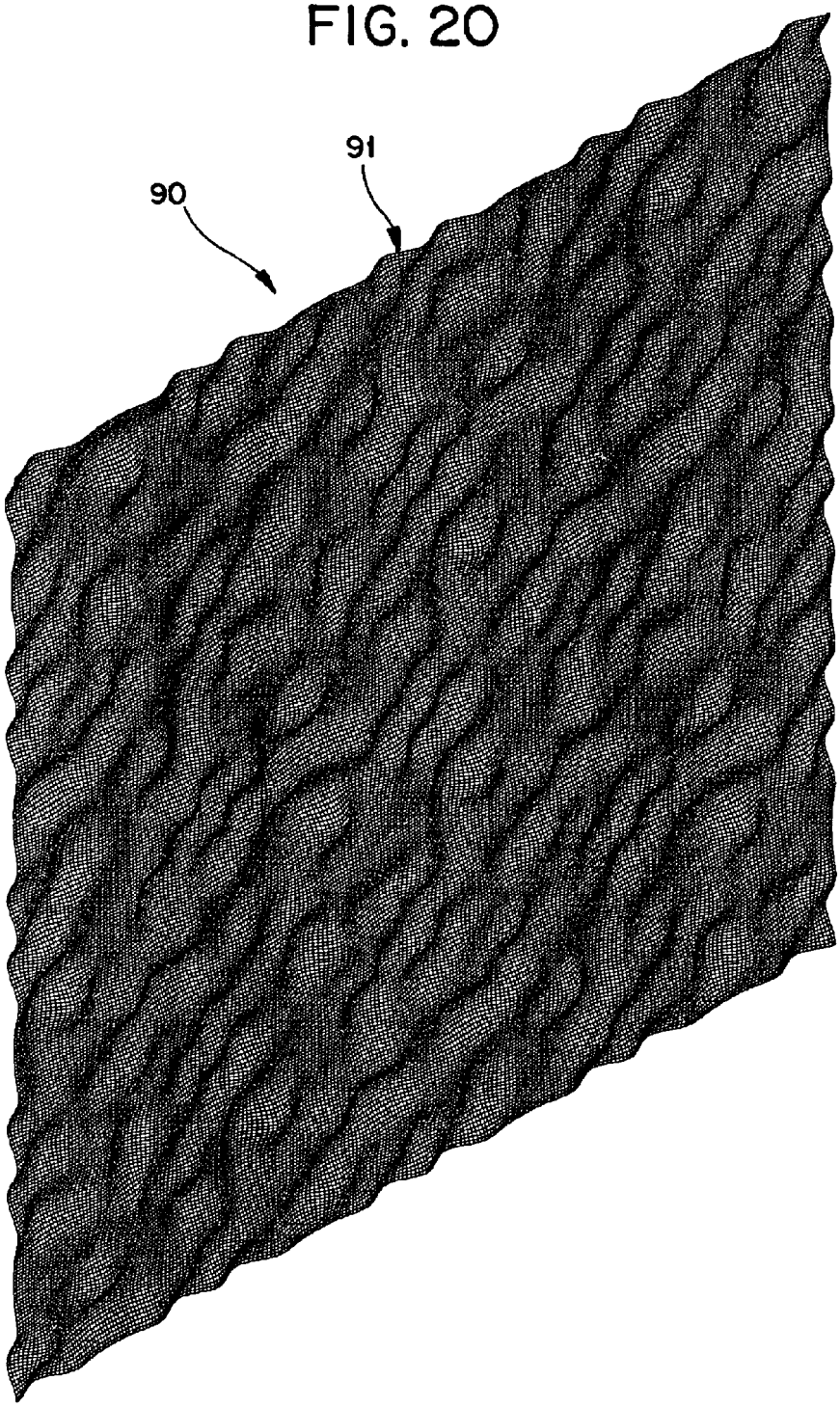
FIG. 20 shows a perspective view of the array illustrated in FIG. 19.

FIG. 20 shows a square diffusor module array 90 representing a perspective view of the array of FIG. 19.

The curved surface of the array 90 has curvature in two or more planes, but the edges of the panels 80 are all identical symmetrical curves, thereby allowing the panels 80 to be pieced together in any orientation with displacement continuity at the edges. The periphery of the array 90 is generally designated by the reference numeral 91. It is also noted that the surface displacement gradient is set to be zero at the periphery 91 of the array 90 so that there is no gradient discontinuity when the base shapes 80 are tiled together in any orientation. Despite this, the shape is asymmetrical in the middle, enabling different visual patterns to be formed by changing the modulation method employed.

In mathematical terms, this concept can be explained as follows. The base shape is given by z(x,y). The surface is assumed to have a width "h" and is square in configuration. The identical symmetrical edge displacement can thus be mathematically stated as:

$$z(0,y)=z(0,h-y)0\leqq y\leqq h$$

$$z(h,y)=z(h,h-y)0\leqq y\leqq h$$

$$z(\alpha,h)=z(0,\alpha)0\leqq \alpha\leqq h$$

$$z(\alpha,0)=z(0,\alpha)0\leqq \alpha\leqq h \tag{1}$$

The zero gradient at the edge requirement can be expressed as:

$$\left.\frac{\partial z(x,y)}{\partial x}\right|_{x=0}=0 \quad 0\leq y\leq h \tag{2}$$

$$\left.\frac{\partial z(x,y)}{\partial x}\right|_{x=h}=0 \quad 0\leq y\leq h$$

$$\left.\frac{\partial z(x,y)}{\partial y}\right|_{y=0}=0 \quad 0\leq x\leq h$$

$$\left.\frac{\partial z(x,y)}{\partial y}\right|_{y=h}=0 \quad 0\leq x\leq h$$

With reference to FIGS. 21–26, a rectangular version of the diffusor module 80 is generally designated by the reference numeral 100. FIG. 21 best shows the compound curvature of the surface while FIG. 26 best shows its rectangular configuration.

Figure 27:
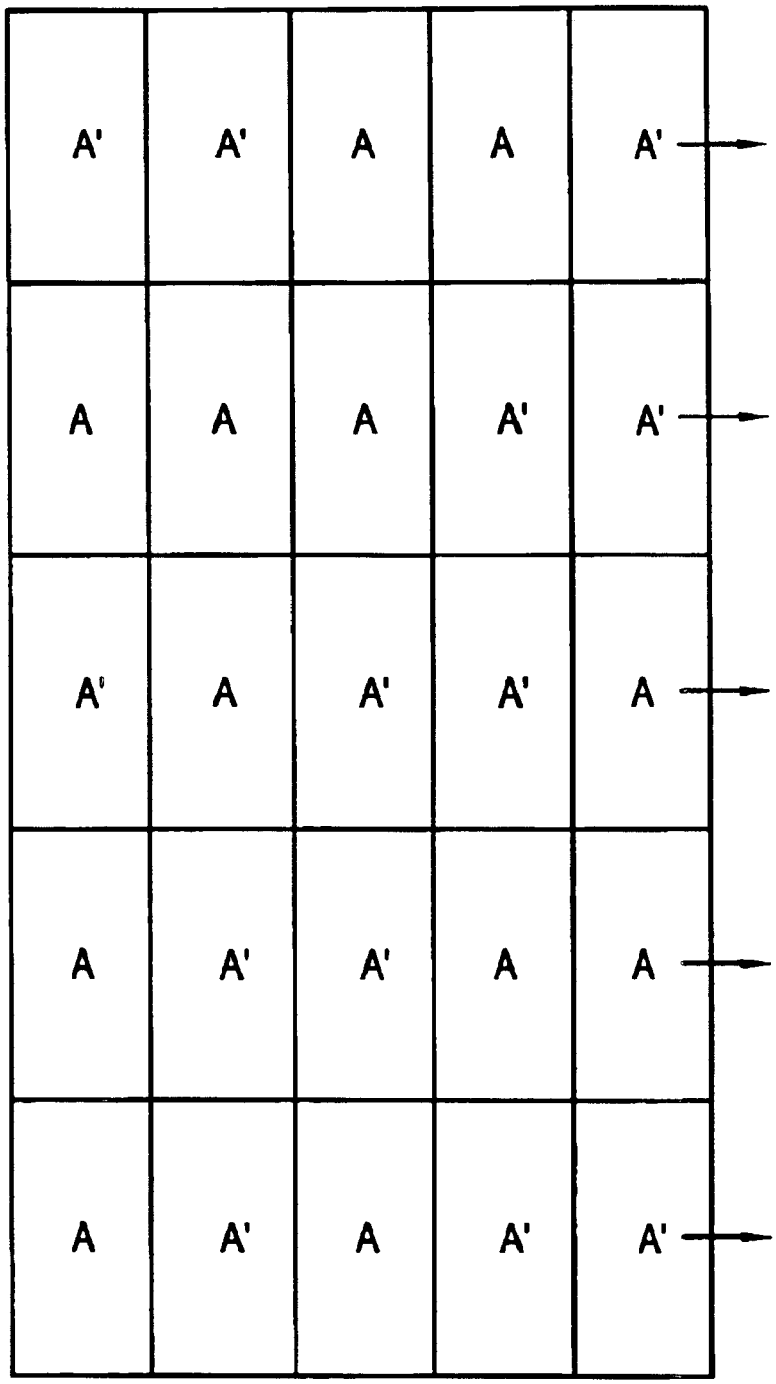
FIG. 27 shows one possible tiling pattern of the diffusor of FIGS. 21–26 in which the diffusors designated "A" correspond to the view of FIG. 26 and in which diffusors identified as "A'" comprise the diffusor as illustrated in FIG. 26 but rotated 180°.
Figure 28:
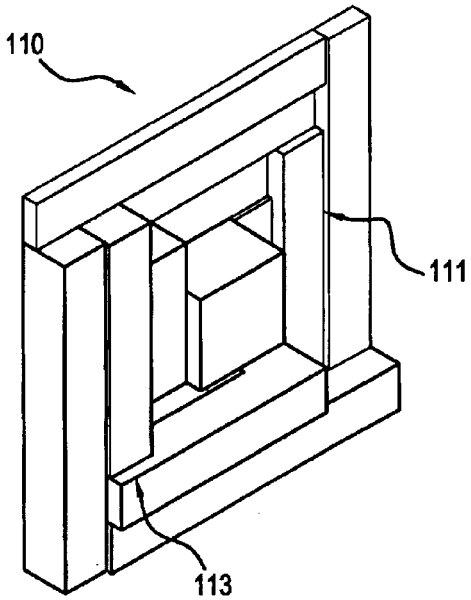
FIG. 28 shows a perspective view of an example of a varying height "Log Cabin" sound diffusor.
Figure 29:
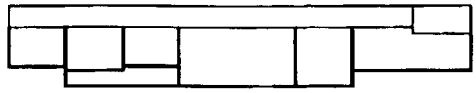
FIG. 29 shows a top view of the diffusor of FIG. 28.

FIG. 27 shows one possible modulation sequence. Given the rectangular nature of the diffusor module 100, its available orientations are limited as compared to a square diffusor. Thus, in FIG. 27, the reference letter A is used to depict the diffusor module 100 in the orientation shown in FIGS. 21 and 26. The reference letter A' is used to denote the same diffusor module but rotated 180° so that it is inverted.

Figure 30:
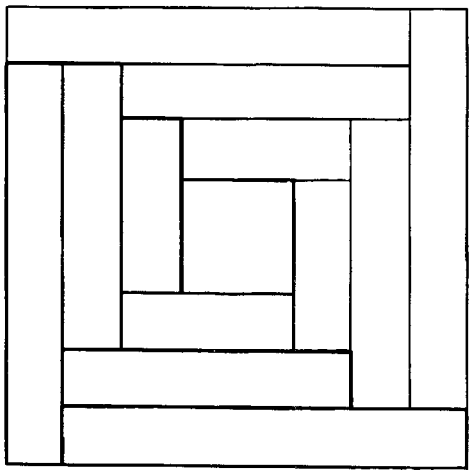
FIG. 30 shows a front view of the diffusor of FIG. 28.
Figure 31:
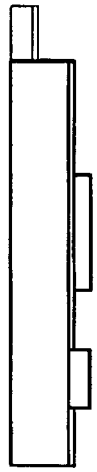
FIG. 31 shows a side view of the diffusor of FIG. 28.
Figure 32:
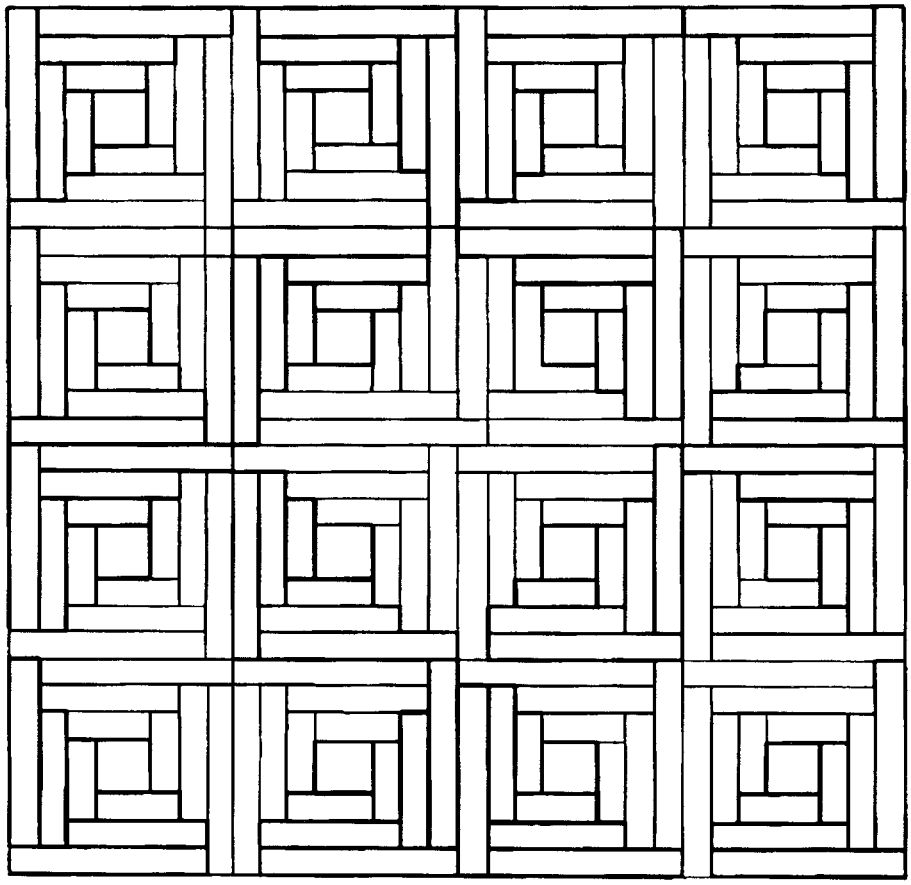
FIG. 32 shows one possible tiling pattern for the diffusor of FIG. 28 with each diffusor having a particular rotational orientation with respect to the view of FIG. 30.

With reference now to FIGS. 28–32, an asymmetric base diffusor module is shown designated by the reference numeral 110 and has what is known in the art as the "classic quilting pattern" known as "Log Cabin." As best seen in FIG. 30, the diffusor module is square-shaped and may be divided into two halves, diagonally, by color or by height variation. FIG. 32, in particular, shows this division by color. In the preferred embodiment, one side of the diagonal has variable but low steps while the other side has variable but higher steps. This configuration is best seen with reference to FIGS. 28 and 29 in which the portion having lower steps is generally designated by the reference numeral 111, and wherein the portion having higher steps is generally designated by the reference numeral 113. In this shape diffusor module, it is possible to form a large number of different patterns depending upon how the base shapes are arranged. FIG. 32 shows one such arrangement showing the same basic diffusor module but with different ones of the diffusor modules rotated to different orientations as is clearly shown in FIG. 32. Such an arrangement provides an effective diffusor module array that is also aesthetically pleasing, and includes different visual patterns when viewed with concentration on different areas thereof.

FIGS. 33–38 show a "Log Cabin" base shape 120 in which the shape is provided by curved surfaces rather than stepped surfaces. As may be understood from FIGS. 34 and 36, in particular, in a similar manner to the diffusor of FIGS. 28–32, shallow curves 121 are formed on one side of a diagonal, whereas higher curves 123 are provided on another side of a diagonal. The diagonal is generally designated by the reference numeral 122 as best seen in FIGS. 33 and 38.

Figure 39:
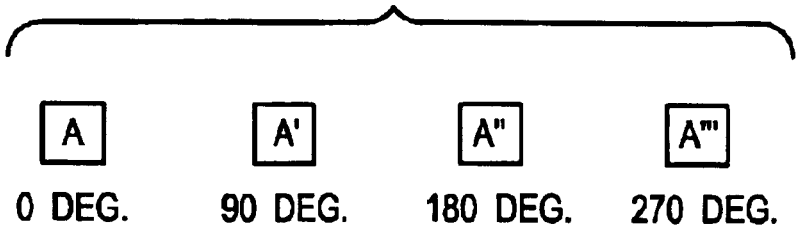
FIG. 39 shows a schematic representation of four variations of the diffusor illustrated in FIGS. 33–38, with each variation consisting of the identical diffusor rotated 90° with respect to adjacent units.
Figure 40:
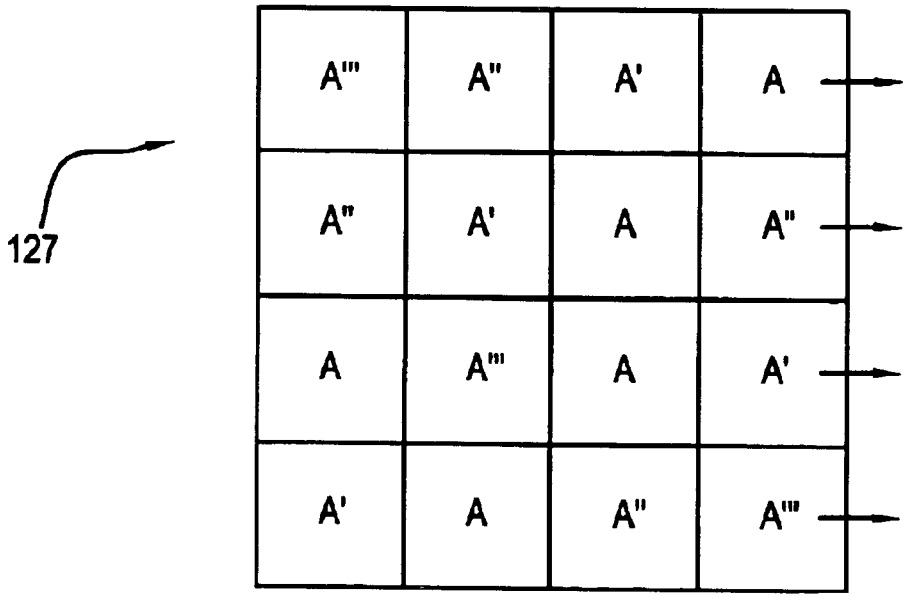
FIG. 40 shows an aperiodic array of the diffusors as oriented as illustrated in FIG. 39.

FIGS. 39 and 40 show one example of a tiling pattern using the diffusor module 120. FIG. 39 identifies four different rotative orientations of the diffusor module 120 rotatively separated by 90° and FIG. 40 shows those different rotative orientations randomly situated on an array 127.

Figure 41:
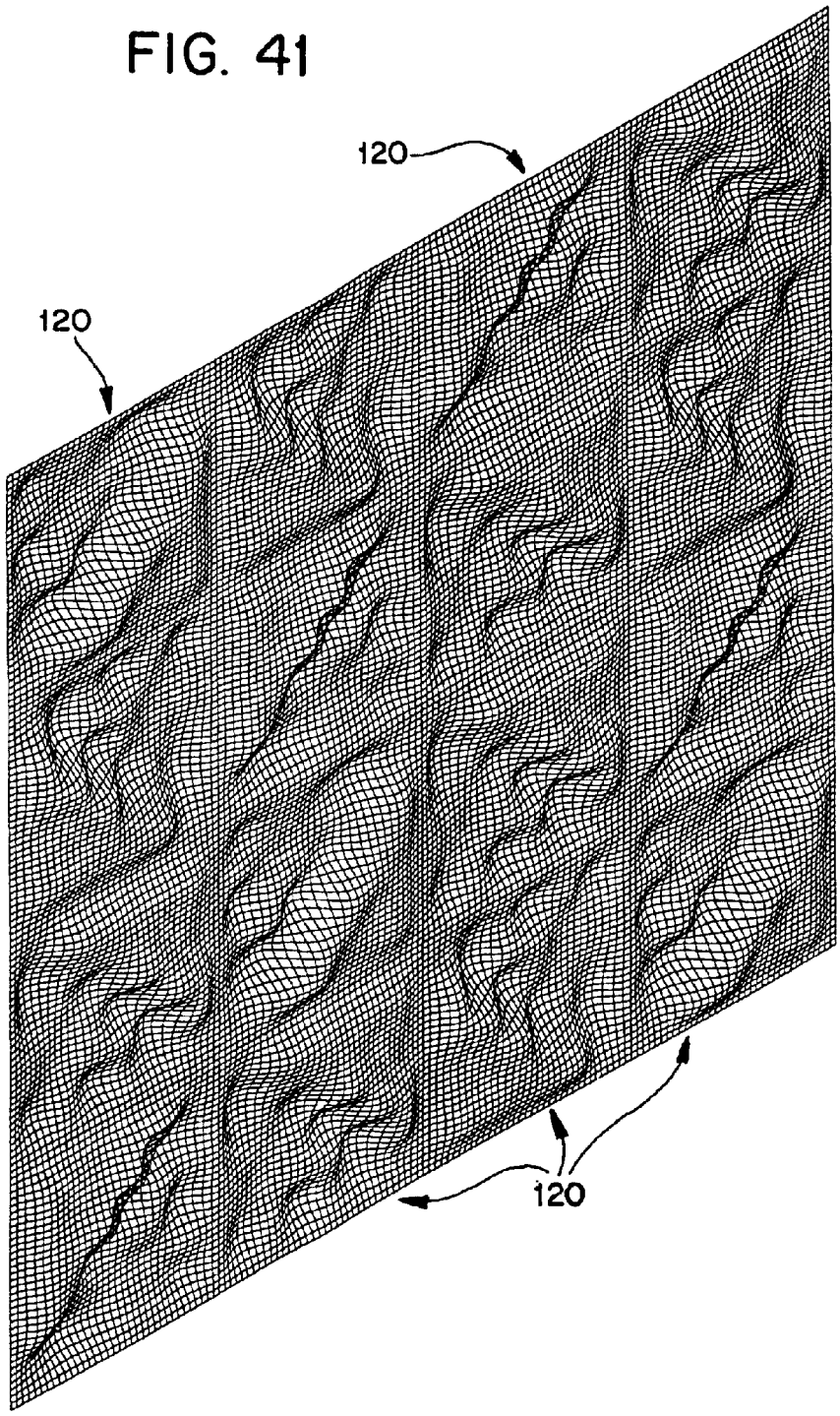
FIG. 41 shows a perspective view of the tiling pattern illustrated in FIG. 40.
Figure 42:
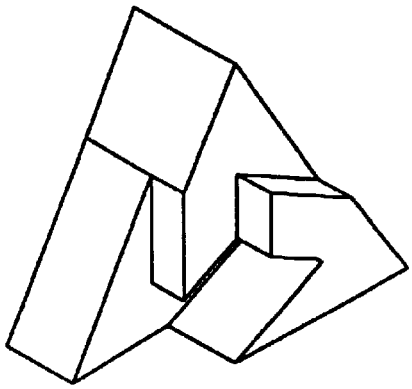
FIG. 42 shows a perspective view of a segmented triangular stepped diffusor.
Figure 43:
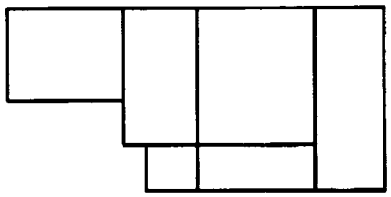
FIG. 43 shows a top view of the diffusor illustrated in FIG. 42.
Figure 44:
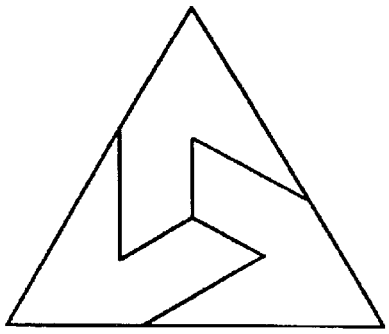
FIG. 44 shows a front view of the diffusor illustrated in FIG. 42.
Figure 45:
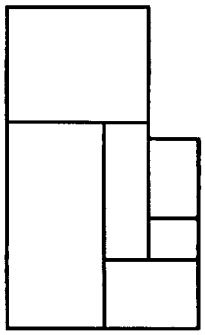
FIG. 45 shows a side view of the diffusor illustrated in FIG. 42.
Figure 46:
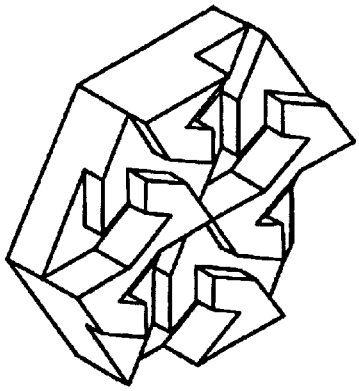
FIG. 46 shows a perspective view of one possible tiling pattern using the diffusor of FIGS. 42–45.
Figure 47:
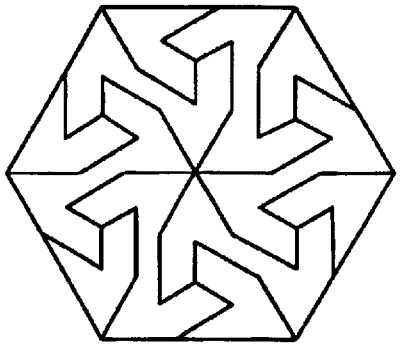
FIG. 47 shows a front view of the tiling pattern illustrated in FIG. 46.
Figure 48:
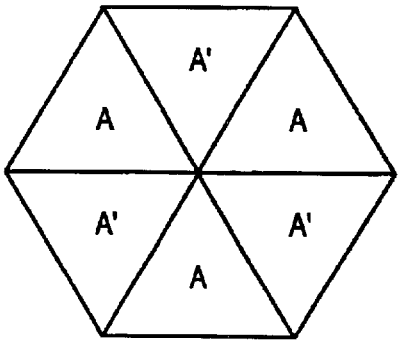
FIG. 48 shows a schematic front view of the tiling pattern illustrated in FIG. 47 with the diffusors denoted by "A" corresponding to the diffusor of FIGS. 42–45, and with the diffusors denoted by "A'" comprising a mirror image of the diffusor of FIGS. 42–45.
Figure 49:
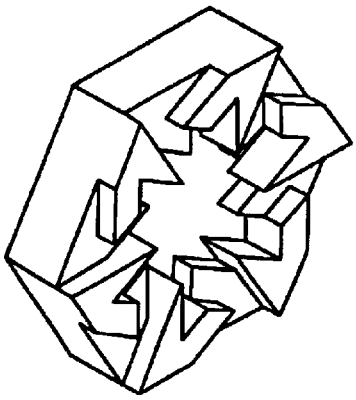
FIG. 49 shows a second alternative construction of a tiling pattern employing the diffusor of FIGS. 42–45.
Figure 50:
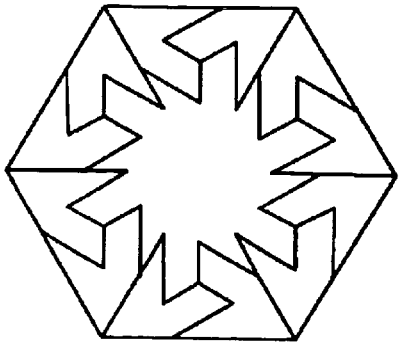
FIG. 50 shows a front view of the tiling pattern illustrated in FIG. 49.
Figure 51:
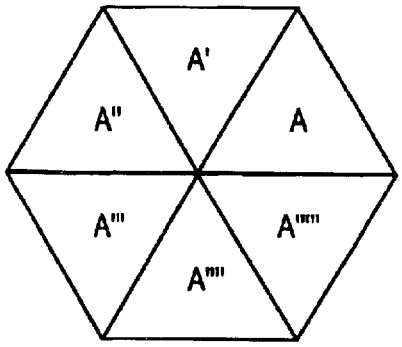
FIG. 51 shows a front schematic representation of the tiling pattern illustrated in FIGS. 49 and 50 showing that each diffusor is a slight variant of the others.
Figure 52:
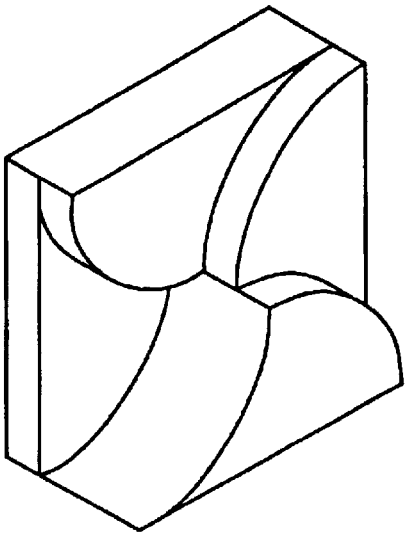
FIG. 52 shows a perspective view of a segmented square stepped diffusor.
Figure 53:
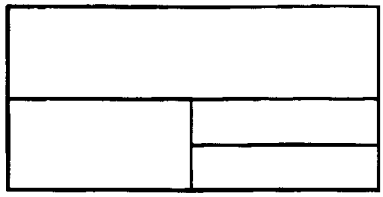
FIG. 53 shows a top view of the diffusor illustrated in FIG. 52.
Figure 54:
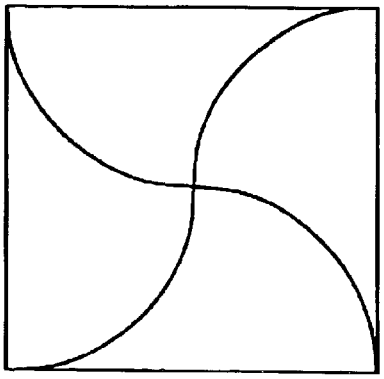
FIG. 54 shows a front view of the diffusor illustrated in FIG. 52.
Figure 55:
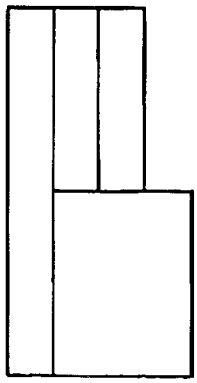
FIG. 55 shows a side view of the diffusor illustrated in FIG. 52.

FIG. 41 shows a number of the diffusor modules 120 assembled together to illustrate one possible modulation surface that enables a visually appealing device to be achieved from a single base shape but with a repeat distance that can be chosen by the designer. In accordance with the teachings of the present invention, height variation allows asymmetric shapes such as that of the diffusor module 120 assembled in an aperiodic tiling pattern such as shown in FIG. 41 to provide effective sound diffusion.

As desired, other asymmetrical base shapes can be formed within a space filling tilable polygon of "n" sides. The total area is subdivided into "n" equal parts and a generator shape is defined. The generator design is such that the total projected area is covered with an n-fold rotation of the generator by 360/n degrees. Each rotated generator has the same projected area, but varying heights. The surface of the generator can be flat, slanted or irregular. The generated asymmetrical unit base shape can then be tiled as desired over the coverage area forming an interesting, aesthetically pleasing aperiodical acoustical sculpture.

For example, a triangular base shape designated by the reference numeral 130 is seen in FIGS. 42–45. FIGS. 46–48 and 49–51, respectively, show two different modulations of this triangular shape. The reference letters A–A'''' are used to depict variations of the basic triangular configuration shown in FIGS. 42–45.

FIGS. 52–55 show an example of a square base shaped diffusor module with FIGS. 56 and 57*a* showing front and perspective views, respectively, of one possible modulation sequence. FIGS. 57*b* and 57*c* explain the rotative orientations of the tiles in the pattern of FIG. 57*a*.

Figure 65:
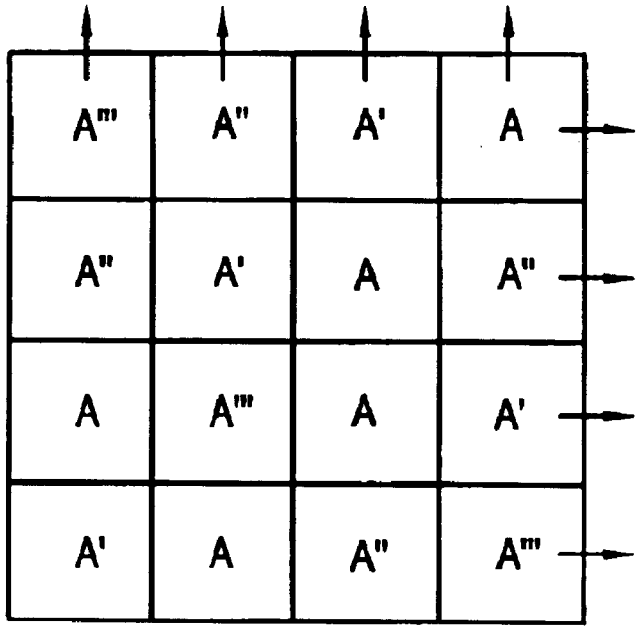
FIG. 65 shows an aperiodic array of the diffusors as oriented as illustrated in FIG. 64.
Figure 64:
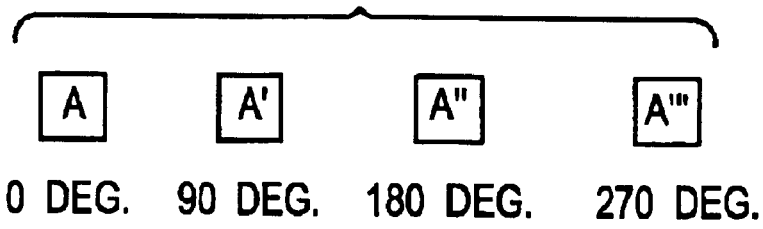
FIG. 64 shows a schematic representation of four variations of the diffusor illustrated in FIGS. 58–63, with each variation consisting of the identical diffusor rotated 90° with respect to other examples thereof.

FIGS. 58–63 show a tilable fractal asymmetrical base shape with FIGS. 64 and 65 showing one possible modulation sequence. As should be understood, it is possible to generate an asymmetrical fractal base shape surface with any degree of jaggedness or curvature and to morph this surface into a square shape with identical and symmetrical sides having zero gradient so that adjacent diffusors can be assembled together with smooth transition therebetween. As shown in FIG. 64, each diffusor module 150 (FIGS. 58–63) can be provided in any one of four orientations rotated with respect to one another by 90°. The four different possibilities are depicted in a random pattern in the array shown in FIG. 65.

Figure 67:
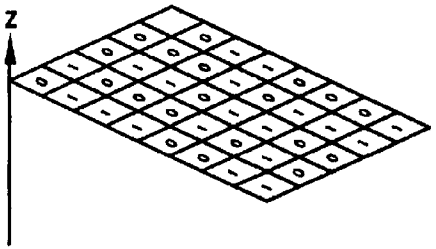
FIGS. 67, 68 and 69 show the three binary planes used to form the volume diffusor illustrated in FIG. 66—a "0" indicates the asymmetrically shaped diffusor module in a first orientation, and a "1" corresponds to an inverted orientation of a diffusor module.
Figure 68:
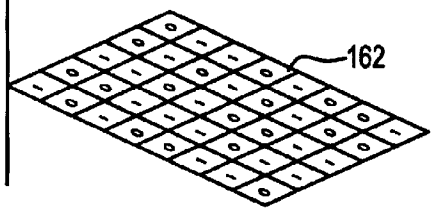
Figure 69:
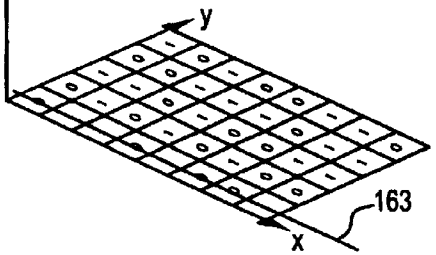
Figure 66:
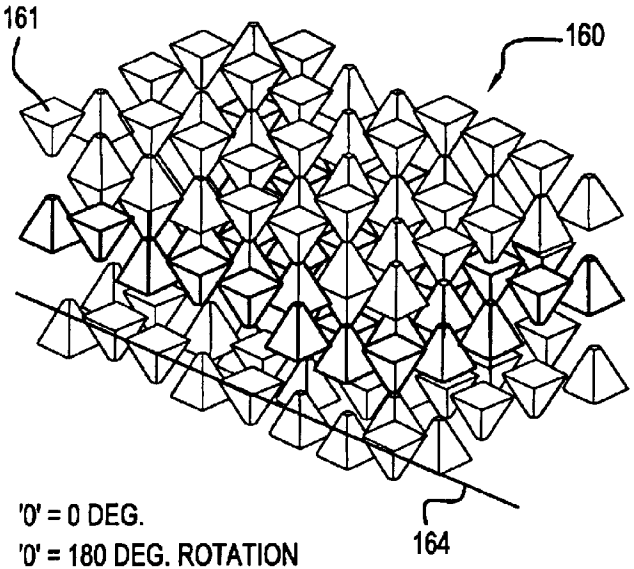
FIG. 66 shows a 3×5×7 binary optimized volume diffusor.

To this point, this application has described asymmetrical surface diffusors that can be tiled or modulated on a surface in two directions. The present invention is also applicable to diffusors that can be tiled or modulated in three dimensions or three directions. Thus, FIGS. 66–69 show a 3×5×7 flipped unit volume diffusor. FIG. 66 shows a perspective view of the diffusor generally designated by the reference numeral 160, and FIGS. 67–69 show the two-dimensional binary layers which provide the prescription for forming the diffusor 160 shown in FIG. 66. In FIGS. 67–69, the squares having the number "0" therein are intended to depict the orientation of one truncated pyramid 161 of the diffusor 160 shown in FIG. 66 while those squares including the number "1" are intended to depict one truncated pyramid 161 inverted 180° from the orientation shown in FIG. 66. The middle plane 162 (FIG. 68) is shaded in FIG. 66 for clarity. The orientation of the truncated pyramids 161 in row 163 (FIG. 69) can be seen in row 164 in diffusor 160 (FIG. 66). In general, any orientation change that differentiates the asymmetrical base shape is sufficient. The truncated pyramids 161 are meant to represent any asymmetrical three-dimensional base shape and any three-dimensional asymmetrical shape can be substituted therefor.

With reference to FIGS. 70–73, a 3×5×7 unit volume diffusor is generally designated by the reference numeral 170 in FIG. 70 and made up of an array of a plurality of teardrop-shaped solids 171. In FIGS. 71–73, the squares having a "0" therein are an indication that a solid 171 is present in a space, whereas designation of the number "1" in a square is an indication of an open space with no solid 171 present. This configuration forms a defect lattice of a single asymmetrical base shape. The middle binary plane 172 (FIG. 72) is shaded in FIG. 70 for clarity. The presence or absence of the diffusors in line 173 (FIG. 73) is illustrated at 174 (FIG. 70). Each volume diffusor may be designed to have specific diffraction effects in both transmission and back scattering as is understood by those skilled in the art. Additionally, if desired, the binary planes as, for example, depicted in FIGS. 71–73, can be designed to provide sound absorption.

Figure 74:
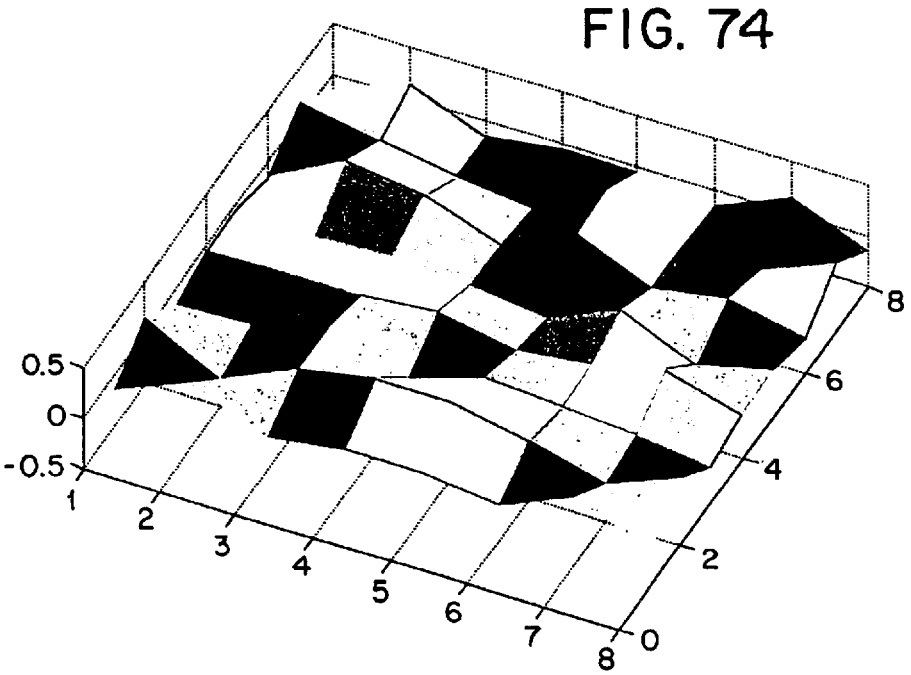
FIG. 74 shows a course grid of displacement points forming a rough base shape.
Figure 75:
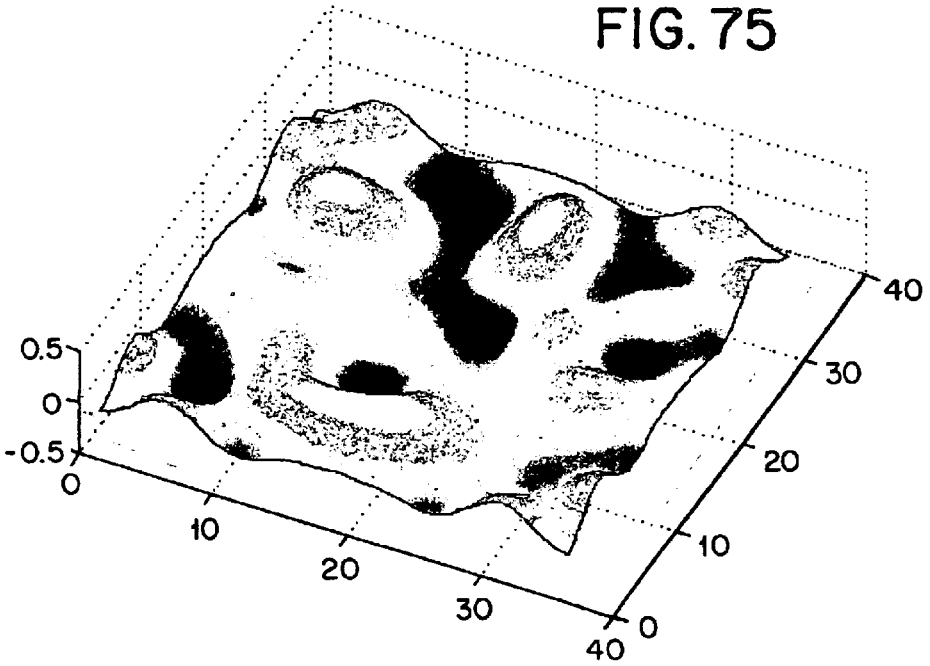
FIG. 75 shows a top view of interpolated rough shape of the diffusor of FIG. 74.
Figure 76:
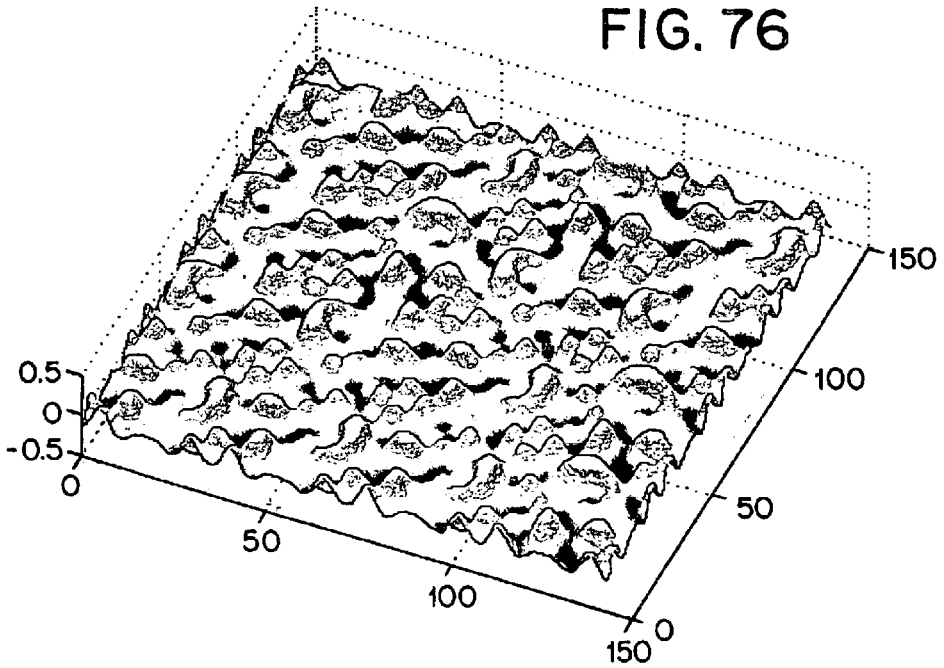
FIG. 76 shows an isometric view of a 4×4 modulated array of the diffusor in FIG. 75.

In accordance with the teachings of the present invention, base shapes or modules can be designated in many different ways. For example, they can be formed from a purely artistic or aesthetic perspective using geometrical or fractal shapes and morphed into a zero gradient specified depth periphery allowing tiling of adjacent shapes with smooth transition. If desired, they can also be formed using a mathematical number theory sequence. Additionally, they can be formed through optimized welled or profiled diffusors. Single or compound curved shapes can be formed using a bi-cubic spline process. In designing diffusor modules of a generally curved topography usable in accordance with the teachings of the present invention, a particular process is followed. As shown, for example, in FIG. 74, a coarse grid of displacement points is formed. The displacement in each point is determined by a random number generator with the edge displacements being forced to be symmetrical using the formula (1) as explained above. Next, gradient at each point is found by numerical differencing. Numerical differencing is a term described in "Numeric Recipes" published by Cambridge Press.© 1986–1992. The gradient of the peripheral edges is set to zero using the equation (2). Then, a bi-cubic interpolation routine is used to form a smooth interpolation through the coarse grid points as best seen in FIG. 75. FIG. 76 shows a 4×4 modulated array of diffusors such as is illustrated in FIG. 75.

Figure 77:
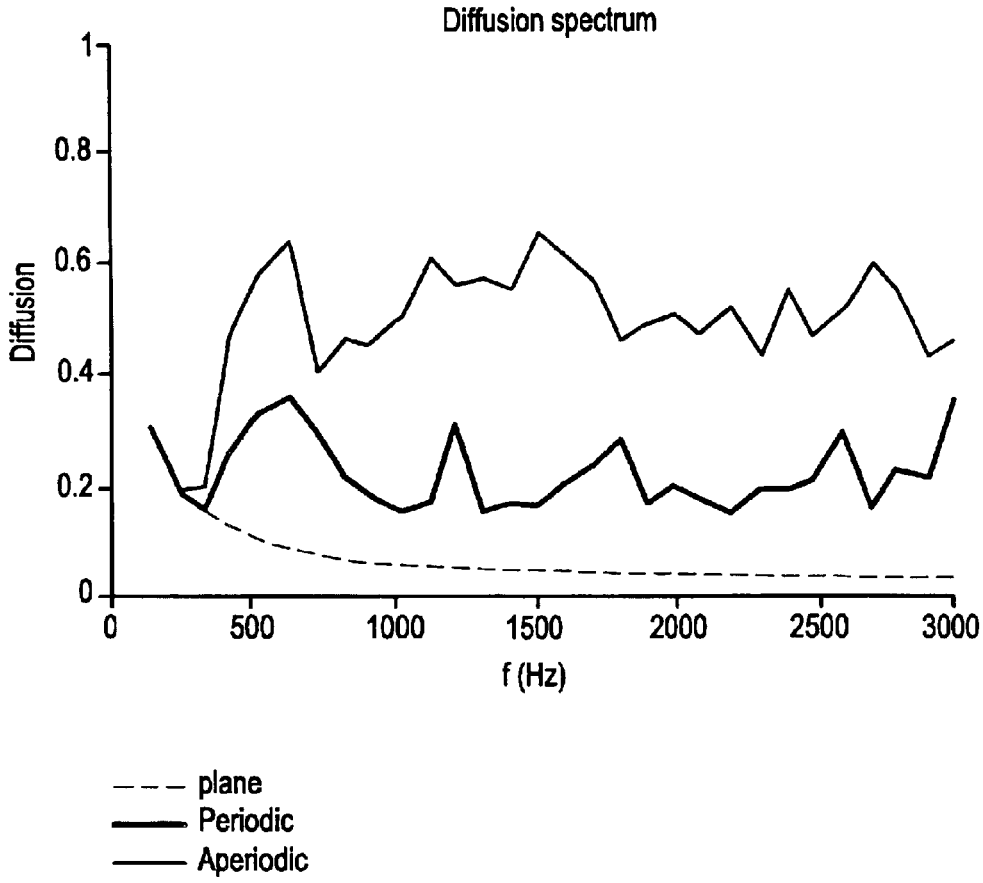
FIG. 77 shows a graph of diffusion spectrum versus diffusion for periodic and aperiodic diffusor arrays.

If the base shapes are not diffusively optimized, then they can be generated and evaluated. The performance of scattering surfaces can be predicted using BEM simulation programs and/or by physical measurement. This is disclosed by Peter D'Antonio and Trevor J. Cox in the publication Two Decades of Room Diffusors. Part 2: Measurement, prediction and characterisation. J.Audio.Eng.Soc. 46(12) 1075–1091. (December 1998). In FIG. 77, the diffusive coefficient is presented for the asymmetrical one-dimension diffusor shown in FIGS. 4–6 in a periodic and modulated arrangement. It can be seen that the diffusion for the modulated arrangement is higher indicating the acoustical benefit of modulation.

As such, an invention has been disclosed in terms of preferred embodiments thereof which fulfill each and every one of the objects of the invention as set forth hereinabove, and provide new and useful embodiments of aperiodic tiling of a single asymmetrical diffusive base of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A sound diffusor comprising an aperiodic array of diffusor modules including a first module having an asymmetrical surface pattern oriented in a first orientation and at least a second module having the same surface pattern as that of the first module but oriented in a second orientation, said modules combining together to diffuse sound waves with (1) enhanced diffusion, and (2) scattered energy lobing minimized as compared to diffusion and scattered energy lobing that would occur were the modules all oriented in said first orientation.

2. The sound diffusor of claim 1, further including a third module having said asymmetrical surface pattern and oriented in either said first orientation or said second orientation.

3. The sound diffusor of claim 2, wherein said first, second and third modules are randomly arranged in said array.

4. The sound diffusor of claim 1, further including a third module having said asymmetrical surface pattern and oriented in a third orientation.

5. The sound diffusor of claim 4, wherein said first, second and third modules are randomly arranged in said array.

6. The sound diffusor of claim 4, further including a fourth module having said asymmetrical surface pattern and oriented in a fourth orientation.

7. The sound diffusor of claim 6, wherein said fourth module is randomly arranged in said array.

8. The sound diffusor of claim 1, wherein each module is rectangular.

9. The sound diffusor of claim 8, wherein said second orientation is rotated 180° with respect to said first orientation.

10. The sound diffusor of claim 1, wherein each module is substantially square.

11. The sound diffusor of claim 2, wherein each module is substantially square.

12. The sound diffusor of claim 7, wherein each module is substantially square.

13. The sound diffusor of claim 1, wherein each module comprises a one-dimensional asymmetrical series of wells.

14. The sound diffusor of claim 13, wherein said series includes a first half well, a last half well, and a plurality of full wells between said half wells.

15. The sound diffusor of claim 14, wherein said series includes said first and last half wells of depth zero, and seven wells therebetween having respective consecutive depths equal to or proportional to the following amounts in inches: 3, 6 7/16, 3 7/8, 5 1/16, 2 11/16, 4 5/8, and 13/16.

16. The sound diffusor of claim 10, wherein each module comprises a two-dimensional diffusor having a multiplicity of wells formed by flat, two-dimensional surfaces.

17. The sound diffusor of claim 16, wherein said flat, two-dimensional surfaces are formed by walls of square cross-section blocks.

18. The sound diffusor of claim 1, wherein each module comprises a single curvature diffusor having a zero gradient periphery.

19. The sound diffusor of claim 18, wherein each module is rectangular.

20. The sound diffusor of claim 1, wherein each module comprises a multiple curved surface diffusor having a zero gradient periphery.

21. The sound diffusor of claim 20, wherein each module is square.

22. The sound diffusor of claim 20, wherein each module is rectangular.

23. The sound diffusor of claim 1, wherein each module comprises a square stepped surface having relatively low steps to one side of a diagonal and relatively high steps to another side of said diagonal.

24. The sound diffusor of claim 1, wherein each module comprises a square surface having relatively low curved surfaces to one side of a diagonal and relatively high curved surfaces to another side of said diagonal.

25. The sound diffusor of claim 1, wherein each module comprises a triangular stepped surface.

26. The sound diffusor of claim 1, wherein each module comprises a fractal base.

27. The sound diffusor of claim 1, wherein each module comprises a three-dimensional shape.

28. The sound diffusor of claim 27, further including a three-dimensional array of modules.

29. The sound diffusor of claim 27, wherein each module comprises a truncated pyramid.

30. The sound diffusor of claim 29, wherein said pyramid has a rectangular base.

31. The sound diffusor of claim 29, wherein said array consists of a multiplicity of said truncated pyramids in which each pyramid is randomly oriented in one of two orientations, a first orientation in which a base of said truncated pyramid is facing downwardly and a second orientation in which said base is facing upwardly.

32. The sound diffusor of claim 28, wherein each module has a three-dimensional teardrop shape.

33. The sound diffusor of claim 32, wherein said array has a multiplicity of spaces, each space randomly either containing a module or being empty.

34. A sound diffusor comprising an aperiodic array of diffusor modules including a first module having an asymmetrical surface pattern oriented in a first orientation, a second module having the same surface pattern as that of the first module but oriented in a second orientation, a third module having said asymmetrical surface pattern and oriented in a third orientation, and a fourth module having said asymmetrical surface pattern and oriented in a fourth orientation, each module comprising a two-dimensional diffusor having a multiplicity of wells formed by flat, two-dimensional surfaces, said flat, two-dimensional surfaces being formed by walls of square cross-section blocks, each module being square.

35. A sound diffusor comprising an aperiodic array of diffusor modules including a first module having an asymmetrical surface pattern oriented in a first orientation and at least a second module having the same surface pattern as that of the first module but oriented in a second orientation, each module being rectangular, said second orientation is rotated 180° with respect to said first orientation, each module comprising a one-dimensional asymmetrical series of wells, said series including a first half well, a last half well, and a plurality of full wells between said half wells, said first and last half wells having a depth of zero, and said plurality of full wells comprising seven wells having respective consecutive depths equal to or proportional to the following amounts in inches: 3, 6 7/16, 3 7/8, 5 1/16, 2 11/16, 4 5/8, and 13/16.

* * * * *